US005143250A

United States Patent [19]

Freitag

[11] Patent Number: 5,143,250

[45] Date of Patent: Sep. 1, 1992

[54] DESK CADDY FOR REFILLABLY DISPENSING SELF-STICKING FANFOLDED NOTEPAPER FEATURING VERTICALLY MOVEABLE PLATFORM ON TRACKING MEANS

[75] Inventor: L. Wayne Freitag, Oak Ridge, N.J.

[73] Assignee: The Bates Manufacturing Company, Hackettstown, N.J.

[21] Appl. No.: 436,560

[22] Filed: Nov. 14, 1989

[51] Int. Cl.[5] ..... B65H 1/08

[52] U.S. Cl. ..... 221/59; 221/61; 221/154

[58] Field of Search ..... 221/33, 45, 46, 47, 221/52, 56, 58, 59, 61, 154, 279, 312 R, 312 A, 312 B, 312 C; 206/556, 555, 39.7, 39.8; 312/50, 60, 61

[56] References Cited

U.S. PATENT DOCUMENTS

| | | | |
|---|---|---|---|
| D. 101,710 | 10/1936 | Patterson | D19/75 |
| D. 245,783 | 9/1977 | Fieni | D19/75 |
| 3,141,569 | 7/1964 | Hanson | 221/46 |
| 3,221,928 | 12/1965 | Horn | 221/56 X |
| 3,567,293 | 3/1971 | Saleman | 271/279 X |
| 4,416,392 | 11/1983 | Smith | 221/59 X |
| 4,562,938 | 1/1986 | Loder | 221/46 |
| 4,586,629 | 5/1986 | Loder | 221/46 |
| 4,586,630 | 5/1986 | Loder | 221/46 |
| 4,586,631 | 5/1986 | Loder | 221/58 |
| 4,653,666 | 3/1987 | Mertens | 221/45 |
| 4,770,320 | 9/1988 | Miles | 221/33 |
| 4,781,306 | 11/1988 | Smith | 221/33 |
| 4,796,781 | 1/1989 | Windorski | 221/45 |
| 4,921,127 | 5/1990 | Windorski | 271/45 |

FOREIGN PATENT DOCUMENTS

| | | | |
|---|---|---|---|
| 725950 | 10/1942 | Fed. Rep. of Germany | 221/52 |

*Primary Examiner*—David H. Bollinger

[57] ABSTRACT

A refillable desk top dispenser for dispensing fanfolded notepaper is provided which includes a tray having a side wall and a bottom wall for defining a cavity therein, the side wall having a vertical slot therein; a removeable cover for placing over the cavity of the tray having a centrally transverse opening extending therethrough for dispensing single individual sheets of fanfolded notepaper from a stack; a platform of a suitable size for receiving the stack of fanfolded notepaper, having extending tabs thereon adapted to cooperate mechanically with the vertical slots, thereby defining the range of vertical movement of the platform; and spring for upwardly urging the platform towards an upper position on the track means to facilitate the proper dispensation of the notepaper.

4 Claims, 5 Drawing Sheets

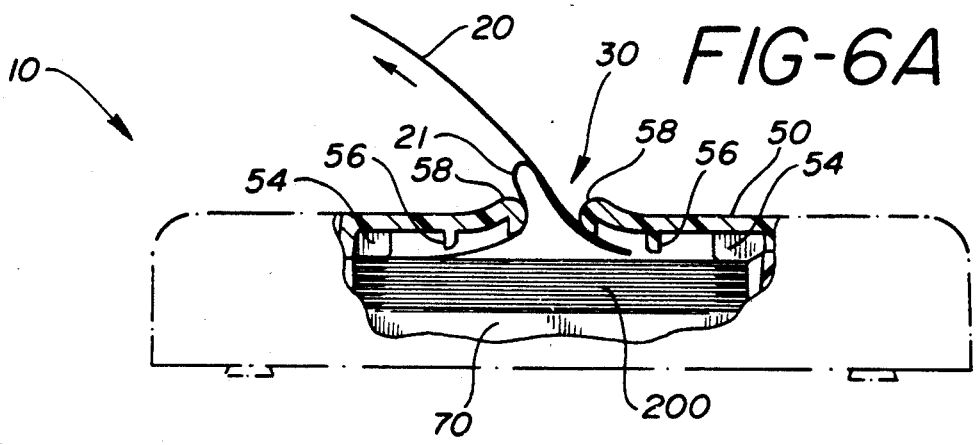
FIG-6A
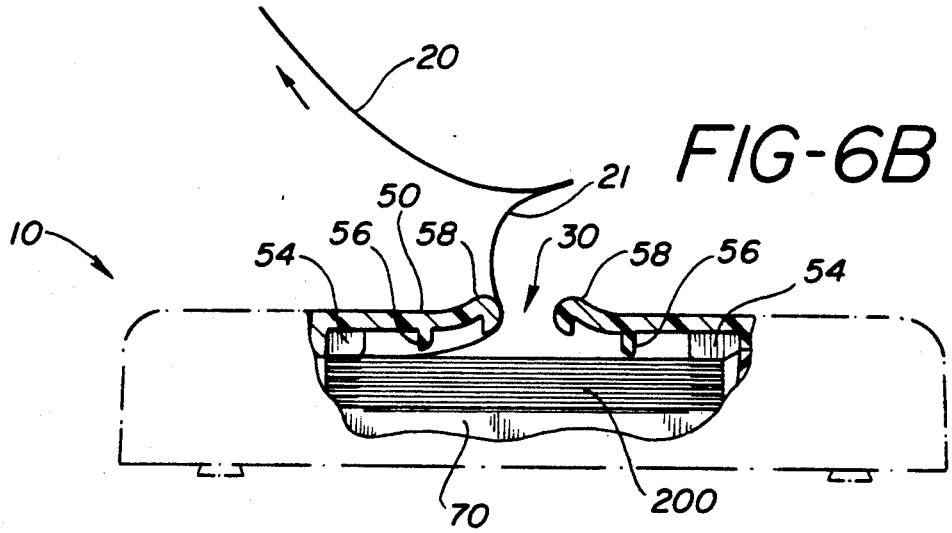
FIG-6B
FIG-6C
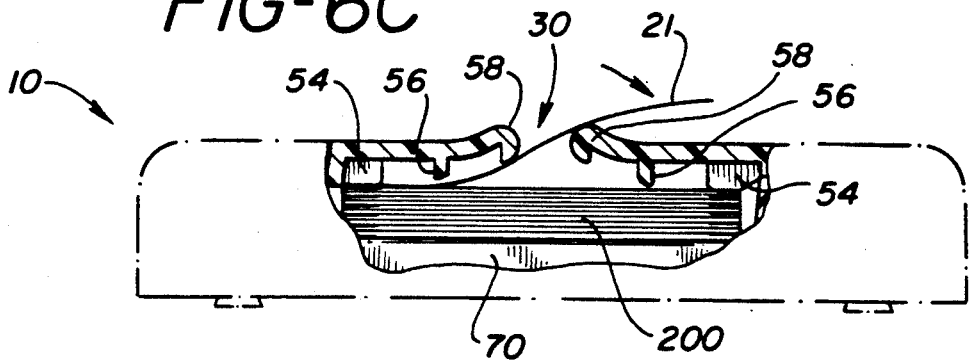

DESK CADDY FOR REFILLABLY DISPENSING SELF-STICKING FANFOLDED NOTEPAPER FEATURING VERTICALLY MOVEABLE PLATFORM ON TRACKING MEANS

FIELD OF THE INVENTION

This invention relates to an improved dispenser for notepaper, and more particularly relates to a refillable desktop dispenser for self-sticking fanfolded sheets of notepaper.

BACKGROUND OF THE INVENTION

Self-sticking notepaper with releasably pressure-sensitive adhesive are a well-recognized office supply across the country. This notepaper was first manufactured having each sheet with a narrow band of adhesive along one edge, successive sheets stacked along that adhesive coated edge, and are commonly known under the registered trademark "POST-IT", owned by Minnesota Mining and Manufacturing Company, St. Paul, Minn., also known as the 3M Company. One major disadvantage of this self-sticking notepaper is that when peeling a sheet from this stack a user cannot distinguish by sight the adhesive edge from the nonadhesive edge and must waste time fumbling with the stack before peeling a sheet off. Another major disadvantage is that the design of the stack of notepaper did not readily lend itself to a convenient dispensing action because successive sheets did not follow each other out of a dispenser or cartridge so the next sheet would be ready for peeling like tissues in a tissue box. The reason for this will become apparent below.

In order to quickly and efficiently dispense this type of notepaper, as one skilled in the art would appreciate, a stack was specifically designed in a fanfold, wherein each separate sheet has a band of adhesive coated along one edge and the sheets are stacked with adhesive coated edges of successive sheets disposed along alternate opposite edges. The dispensing action for this fanfolded notepaper is taught by Smith in U.S. Pat. Nos. 4,416,392 and 4,781,316. This fanfolded notepaper is more easily dispensable than the original non-fanfolded type because upon peeling a separate sheet from the stack in the dispenser, another sheet followed successively like tissues from a tissue box.

In particular, the Smith '392 dispenser shown in FIGS. 1–5 has a box with sides to contain the fanfolded sheets and a top opening, but it is limited in the number of sheets which can be dispensed from a notepad because there is no means to prevent the top sheet of the notepad from falling back through the exit opening as the sheets are being dispensed. When this problem occurs the user is painstakingly required to fish the end of the sheet back through the opening for the remaining sheets, thus defeating the object of the dispenser. This problem also increases in severity as the notepad height increases. (This problem is described in Loder, U.S. Pat. No. 4,562,938, column 2, lines 1–9.)

Smith '392 also teaches an alternative design shown in FIG. 7 to try to avoid this problem wherein a spring pushes fanfolded notepaper towards an opening in the top wall of a refillable container. The container has extended side walls for enclosing the notepaper, and the top wall is formed by two incline portions which terminate at the dispensing opening. It is a disadvantage of this Smith device that during the dispensing action the edges become stressed at the opening and retain a curl after being dispensed. As one skilled in the art would appreciate as the height of the stack of notepaper increases so must the force of the spring pushing it upward. (This disadvantage is described in Windorski, U.S. Pat. No. 4,796,781, column 1, lines 34–38.)

There are many other known disposable and refillable desk-top dispensers known in the art which attempt to overcome the dispensing problem of the Smith '392 designs. For instance, see Loder, in U.S. Pat. Nos. 4,586,629 and 4,596,630, as well as Mertens in U.S. Pat. No. 4,653,666 which all teach different ways to dispense the fanfolded notepaper in a disposable package. While the aforementioned Loder '938 and Windorski '781 patents teach different ways to dispense them in a refillable dispenser.

For instance, Loder '938 teaches a refillable cartridge for a stack of notepaper having gripping means thereon for holding the pads thus preventing the falling back of sheets of the notepaper as dispensed. Windorski '781 teaches a two-piece refillable cartridge having a base for holding the stack of notepaper covered by a weighted body resting thereon.

However, none of these references teaches a dispenser for self-sticking notepaper which is conveniently refillable, easily fabricated, relatively light, and simply constructed and operated, and which will firmly and securely hold a stack of notepaper on a desk to prevent disorder and disarray of the sheets for dispensing one at a time by pulling a sheet extending through a slot.

It is an object of the invention to provide a dispenser for fanfolded notepaper which is a refillable, durable, simple, economical, light, easily fabricated, simple in both design and operation.

It is an object of the invention that the dispenser includes a platform which moves freely on a vertical tracking means upwardly and downwardly.

It is another object of the invention that the vertical tracking means stop that movement at an upper position.

SUMMARY OF THE INVENTION

Accordingly, the present invention provides a refillable desk top dispenser for dispensing fanfolded notepaper comprising: (a) a tray having a side wall and a bottom wall defining a cavity therein, and the side wall having a vertical tracking means; (b) a removable cover for placing over the cavity of the tray, having a centrally transverse opening extending therethrough for dispensing individual sheets of fanfolded notepaper from the stack; (c) a platform of a suitable size for receiving the stack of fanfolded notepaper, having guide means adapted thereon to cooperate mechanically with the vertical tracking means; and (d) biasing means for upwardly urging the platform towards an upper position on the tracking means.

In the preferred embodiment the biasing means includes a spring means; and the tracking means are vertical slots, and guide means are extended tabs for disposing in the vertical slots to slide upwardly and downwardly. In another preferred embodiment the refillable dispenser also further comprises a cover securing means for releasably fastening the removable cover to the tray, and that cover securing means can also be a snapdeflection mechanism capable of providing easy securing and removal of the cover.

Lastly, in the preferred embodiment, the height of the upper position of the vertical track means is determined so that when only a few sheets remain in the stack and only the top sheet touches the cover, upon peeling it off, the next sheet will now touch the cover and have a portion of it extending out of the opening of the cover so that it too is capable of being dispensed.

BRIEF DESCRIPTION OF THE DRAWING

The present invention will more fully understood after reading the following detailed description which refer to the accompanying drawing wherein:

FIGS. 6(*a*) through 6(*c*) show the process by which sheets are dispensed.

FIG. 6(*a*) shows the top sheet being dispensed and withdrawn from the dispenser and then the process pulling the next sheet along out of the dispensing aperture.

FIG. 6(*b*) shows the top sheet totally withdrawn from the aperture with the next now extending out of the aperture.

FIG. 6(*c*) shows the new sheet now falling back into a rest position.

DETAILED DESCRIPTION OF THE INVENTION

Figure 1:
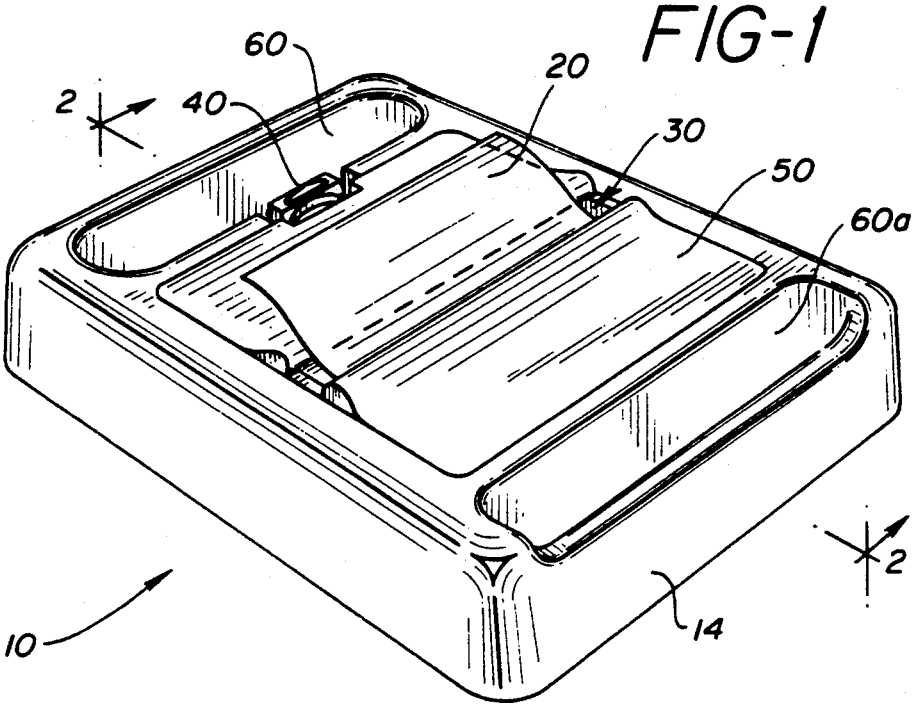
FIG. 1 is a perspective view of a desk caddy note dispenser.

The refillable dispenser for fanfolded notepaper of the present invention is designated generally FIGS. 1–7 as reference numeral 10. As shown in FIG. 1, the dispenser includes a pair of receptacles 60 and 60*a*, a removable cover 50 which is affixed and held in place by a deflectible, snap locking mechanism 40. A sheet of notepaper 20 is shown extending from centrally transverse opening 30 of the cover 50. The refillable dispenser 10 can be manufactured from any one of a number of materials including plastic, wood or brass. And as shown would serve as a desk caddy for office use, not only for dispensing sheets of notepaper one at a time but for storing paper clips, pens and the like in its receptacles.

Figure 2:
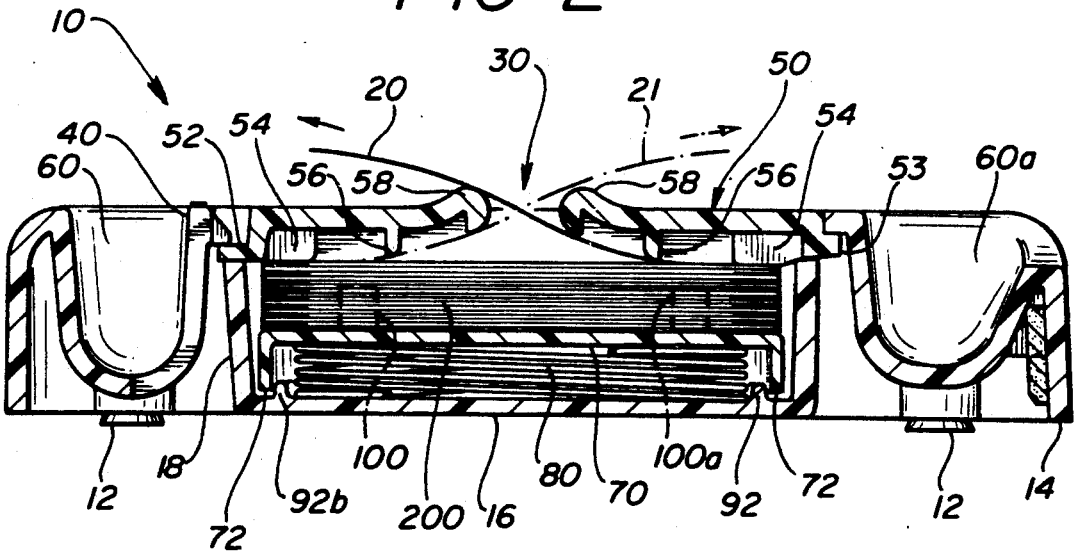
FIG. 2 is a sectional view along lines 2—2 of FIG. 1.

As shown along lines 2—2 of FIG. 1, FIG. 2 illustrates a sectional view of dispenser 10. At this point the reader is also referred to FIG. 5 which is an exploded view of the same device for ease of explanation. On the base of dispenser 10 are preferably rubber pads 12 which serve to protect the veneer of the office desk. As shown, the stack or notepad 200 of fanfolded notes 20 is placed on a moveable platform 70. A sheet of paper 20 is shown extending out of opening 30. Biasing means 80 upwardly urges the platform so that upon removal of individual sheets from the notepad, the stack is urged upwardly towards an upper position 101 in the cavity of the tray (See FIGS. 4 and 5).

As shown in FIG. 2, the notepads 200 rests on platform 70 so that sheet 20 extends out of opening 30 and its adhesive end is urged against drag arm 54 of cover 50. As shown in phantom, sheet 21 has its adhesive end resting against drag arm 54 on the other side of the cover 50. In addition, cover 50 also has guides 56 and curled ends 58. Cover arms 54, guides 56 and curled ends 58 together comprise a dragging means which cooperate in the preferred embodiment of the invention to produce the dispensing action on the respective sheets of the stack. It should be noted at this point that the drag means contributes to the dispensing of a notepaper, but as will be explained herein, this device is designed to work so that when only a few sheets remain in the stack and only the top sheet touches the cover, upon peeling it off, the next sheet will now touch the cover and have a portion of it extending out of the opening of the cover so it is capable of being dispensed. At this point the drag arms 54 are not involved in the dispensing action, and the scope of the invention is by no means limited to their participation.

Tray 10 also has a snap lock deflection 40 which releasably secures cover 50 on the tray and coacts with cover lip 52 and tab 55. The tray also has a base or bottom 16 for supporting a spring means 80, inner guide means 92 and 92*b* for laterally containing spring means 80 within the cavity, and a side wall 18 and 18*a* whose function will become more apparent herein. Lastly, affixed underneath is a magnetic means 14 which functions to assist in a secure containment of paper clips, for instance, in receptacle 60*a*.

Figure 3:
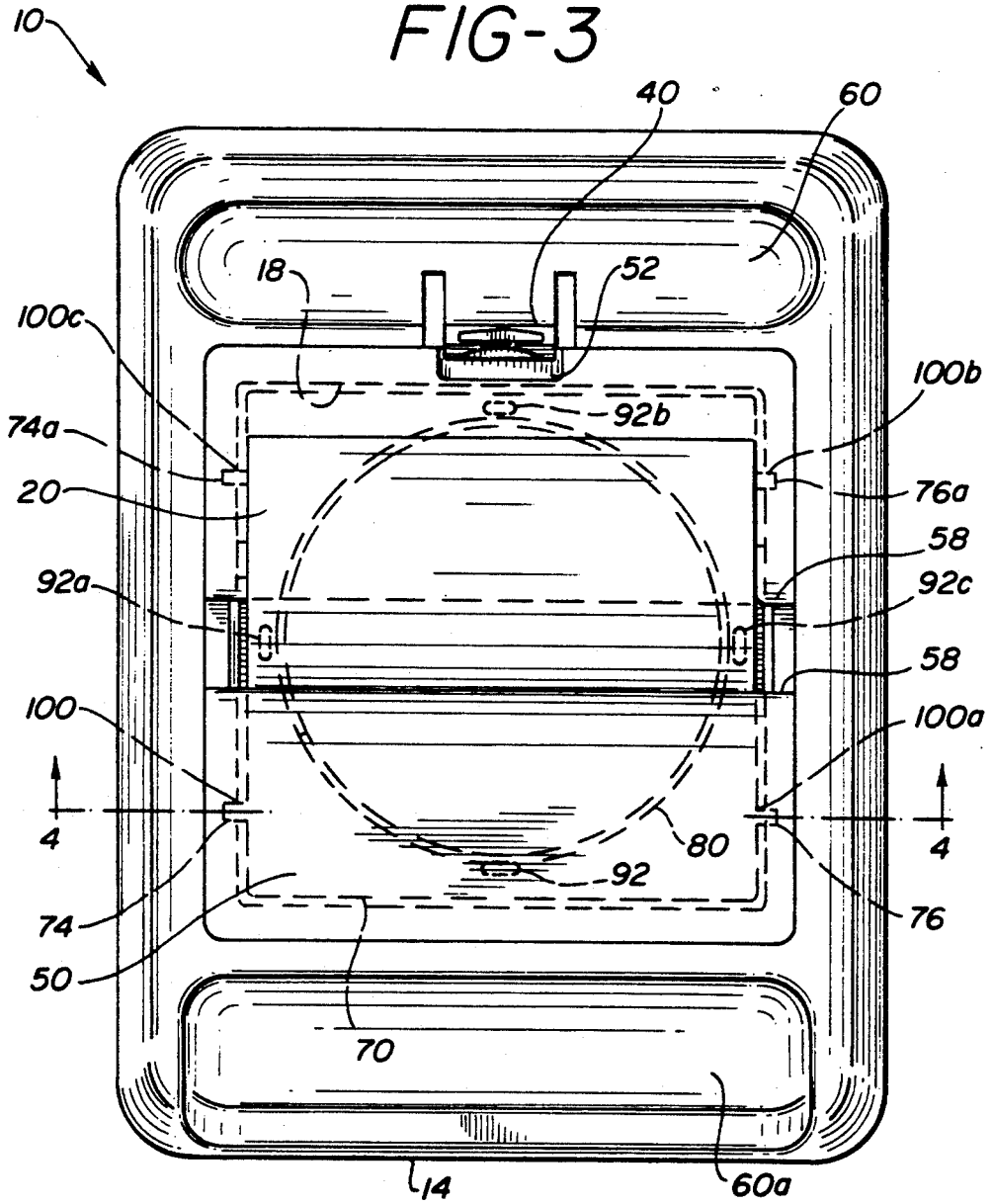
FIG. 3 is a top plan view of the device shown in FIG. 1.
Figure 4:
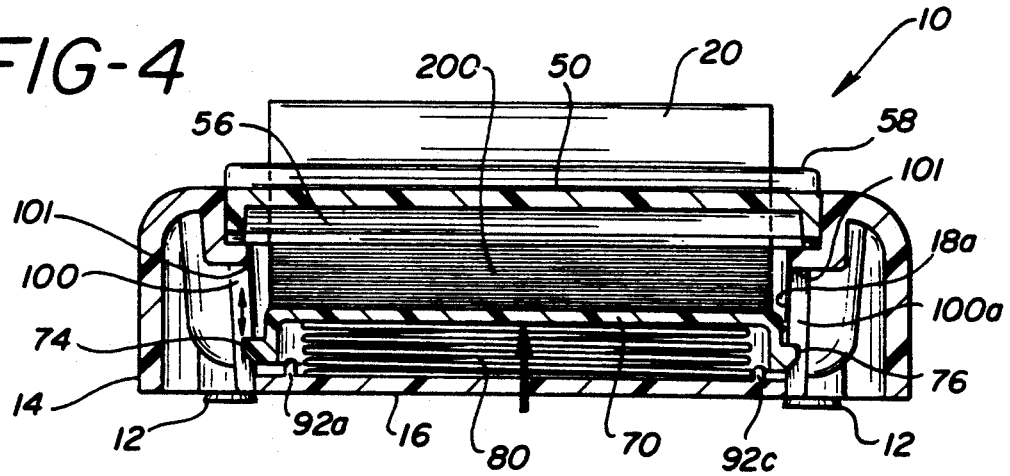
FIG. 4 is a sectional view along lines 4—4 of FIG. 3.

FIGS. 3 and 4 show one embodiment of the vertical tracking means as slots labeled 100, 100*a*, 100*b*, 100*c* in the side walls of the tray.

As shown in FIG. 4, platform 70 has guide means such as extending tabs 74 and 76 which loosely fit with the respective slots and slide upwardly and downwardly therein. The biasing movement of the platform 70 is limited to an upper position when extending tabs 74 and 76 contact the upper end 101 of slots 100 and 100*a*, respectively. The height of the upper position within the cavity of the tray is chosen so that when only a few sheets remain in the stack, and only the top sheet touches the cover, upon peeling off the top sheet in the stack, the next sheet has a portion of it extending cut of the opening of the cover so that it or any of the succeeding sheets never have to be fished out of the cavity, so that no sheets are wasted because of their inability to be dispensed properly. The height of the upper position is a function of two parameters: 1) the height of the stack and 2) the length of a sheet measured from the adhesive to nonadhesive edge.

Figure 5:
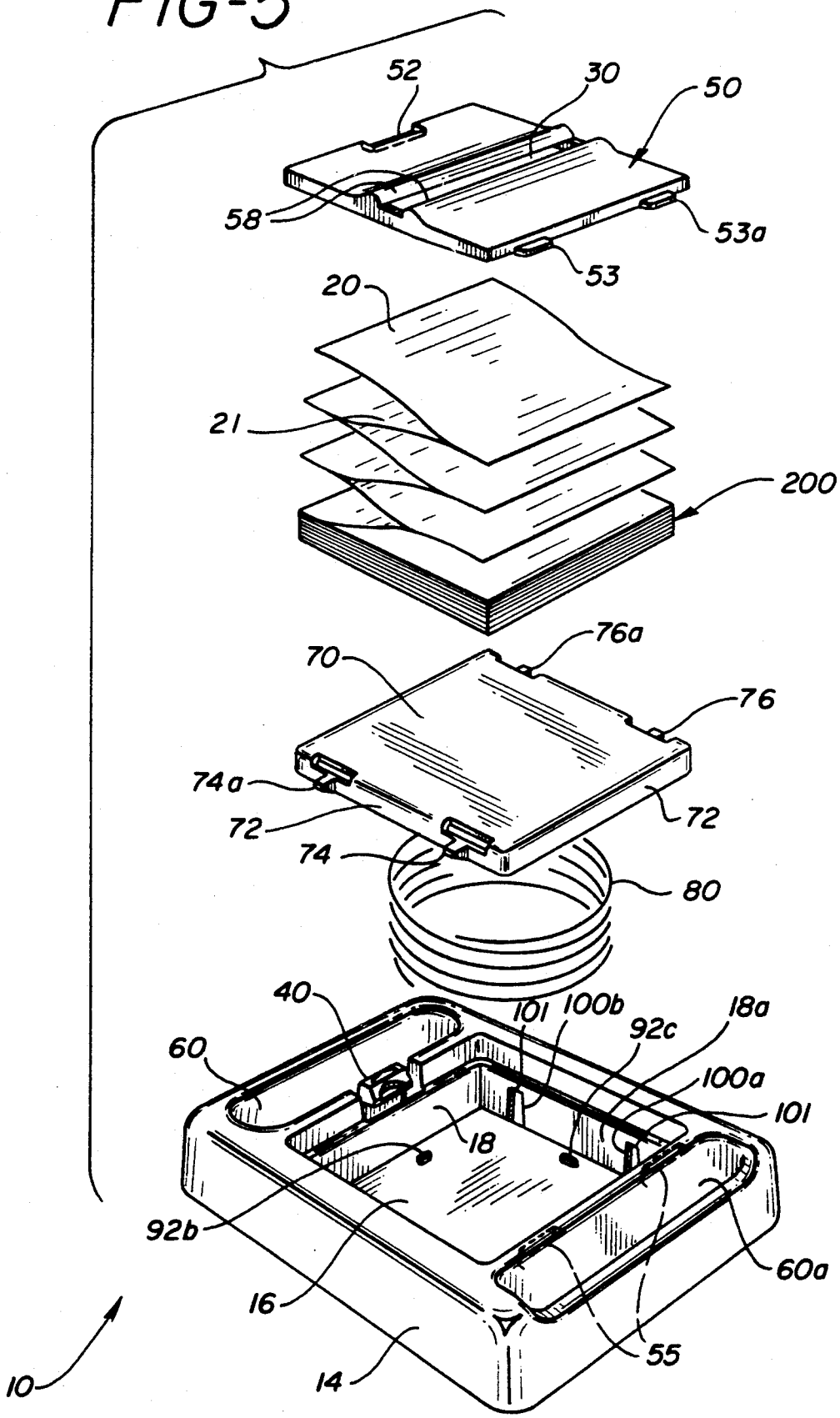
FIG. 5 is an exploded view showing the device and containing a stack of fanfolded notes to be dispensed.

As shown in FIG. 5, a pair of vertical slots 100*a* and 100*b* are shown on one side of the tray, with their corresponding pair of slots 100 and 100*c* not shown in the figure. Spring means 80 is shown between base 80 and platform 70. The spring means may also include sponge or foam means which is compressible. Platform 70 is clearly shown with extending tab 74, 74*a* and 76, 76*a*. Notepaper 200 is shown with its upper two sheets 20 and 21. And lastly, cover 50 is shown with horizontal tabs 53 and 53*a* with cover lip 52 on the other side and centrally transverse opening 30 therein.

FIGS. 6*a* through 6*c*, show a sequential displacement of sheets 20 and 21 from opening 30. As sheet 20 is pulled left-wardly, its adhesive end is pulled from drag arm 54, past cover guide 56 and out past curl 58. As shown in FIG. 6*b*, sheet 20 is pulled out of opening 30 and may release itself from its successive companion sheet 21. At this point as shown in FIG. 6*C* companion sheet 21 falls back onto curl 56 where it is in position to be dispensed later on.

It should be noted at this point that the dispenser 10 may also be designed so that the vertical tracking means mechanically connects the platform 70 to the base 16 of the tray with a wire or the like which acts as a tether. For this embodiment the upper portion of the platform is limited by the length of the tether.

Figure 7:
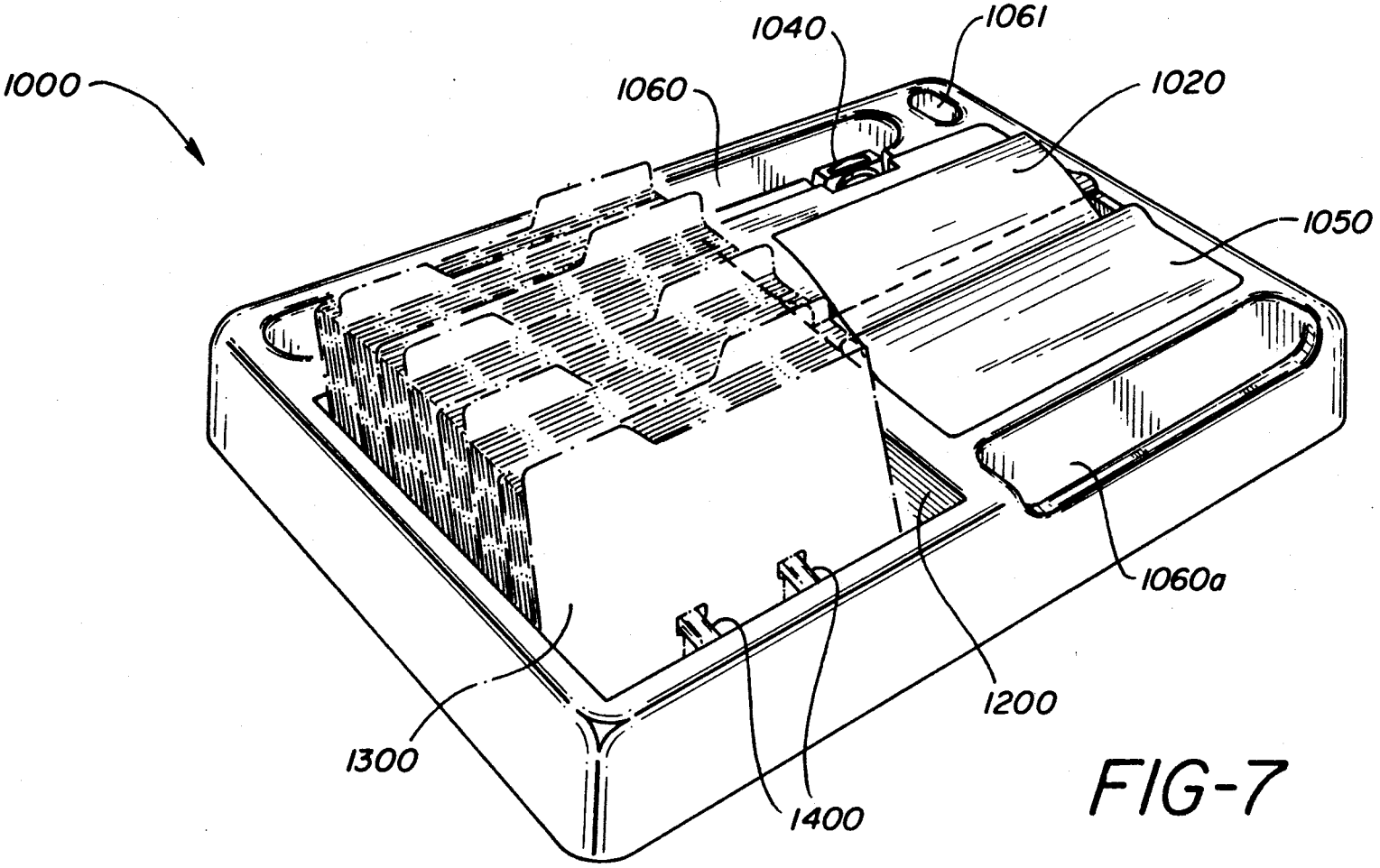
FIG. 7 shows a perspective view of an alternative embodiment of the desk caddy note dispenser shown in FIG. 1.

FIG. 7 shows an alternative embodiment of the dispenser designated therein as dispenser 1000. It has a pair of receptacles 1060 and 1060*a* with a smaller receptacle 1061 usable to store a pen or a pencil. The dispenser also makes a provision for a rack of index cards 1300 which move on track 1400 within cavity 1200. A snap deflection means 1040 fastens removable cover 1050 onto the dispenser and allows for the filling and refilling of a stack of notepaper for which only sheet 1020 is shown.

Therefore, it is to be understood that the present disclosure and embodiment of this invention described herein are for purposes of illustration and example and that modifications and improvements may be made thereto without departing from the spirit of the invention or from the scope of the claims. The claims, therefore, are to be accorded a range of equivalents commensurate in scope with the advance made in the art.

I claim:

1. A refillable dispenser for dispensing a stack of fanfolded notepaper having each sheet coated with a narrow adhesive band along one edge on one side, the sheets being stacked with adhesive-coated edges of successive sheets disposed along alternative opposite edges, the refillable dispenser comprising:

(a) a tray having at least one side wall and a bottom wall defining a cavity therein, the at least one side wall having a vertical tracking means for defining vertical movement within the cavity;

(b) a removable cover for placing over the cavity of the tray, having a centrally transverse opening extending therethrough for dispensing individual sheets of fanfolded notepaper from a stack;

(c) cover securing means for releasably fastening the removable cover to the tray, the cover securing means comprising:

a snap deflection member disposed on the top of one of said side walls or said removeable cover;

a shoulder disposed on the other of said removeable cover or one of said side walls adapted to coact with said deflection member;

tab means extending from said removable cover on the side opposite the deflection member; and recess means disposed in said side wall adjacent said tab means adapted to coact with said tab means;

(d) a platform of suitable size for receiving a stack of fanfolded notepaper, having guide means for controlling movement of the platform, said guide means cooperating with the vertical tracking means; and (e) biasing means for upwardly urging the platform towards and upper position of the vertical tracking means.

2. A refillable dispenser for a stack of fanfolded notepaper comprising:

(a) a tray having at least one side wall and a bottom wall defining a cavity therein, the at least one side wall having vertical tracking means for defining vertical movement within the cavity;

(b) a removable cover for placing over the cavity of the tray having a centrally transverse opening extending therethrough for dispensing individual sheets of fanfolded notepaper from a stack;

(c) cover securing means for releasably fastening the removable cover to the tray, the cover securing means comprising:

a snap deflection member disposed on the top of one of said side walls or said removable cover;

a shoulder disposed on the other of said removable cover or one of said side walls adapted to coact with said deflection member;

tab means extending from said removeable cover on the side opposite the deflection member; and recess means disposed in said side wall adjacent said tab means adapted to coact with said tab means;

(d) a platform of suitable size for receiving a stack of fanfolded notepaper, having guide means for controlling movement of the platform;

(e) biasing means for urging the platform away from the base of the tray;

(f) bias limiting means connected to, and mechanically interconnecting, the tray and the platform, said bias limiting means including a tether comprising end points on said vertical tracking means, which end points coact with the guide means on said platform to limit upward movement of said platform.

3. A refillable dispenser for dispensing a stack of fanfolded notepaper having each sheet coated with a narrow adhesive band along one edge on one side, the sheets being stacked with adhesive-coated edges of successive sheets disposed along alternative opposite edges, the refillable dispenser comprising:

(a) a tray, of a unimold piece of plastic, having two opposing side walls and a bottom wall defining a cavity therein, each side wall having a vertical tracking means for defining vertical movement within the cavity;

(b) a platform of a suitable size for receiving a stack of fanfolded notepaper, having guide means for controlling movement of the platform within the cavity, said guide means cooperating with the vertical tracking means;

(c) biasing means for upwardly urging the platform towards an upper position of the vertical tracking means;

(d) a removable cover for placing over the cavity of the tray, having a centrally transverse opening extending therethrough for dispensing individual sheets of fanfolded notepaper from the stack; and (e) cover securing means for releasably fastening said cover to said tray, the cover securing means comprising:

a snap deflection member disposed on the top of one of said side walls or said removeable cover;

a shoulder disposed on the other of said removeable cover or one of said side walls adapted to coact with said deflection member;

tab means extending from said removeable cover on the side opposite the deflection member; and recess means disposed in said side wall adjacent to said tab means adapted to coact with said tab means.

4. A refillable dispenser for dispensing a stack of fanfolded notepaper comprising:

(a) a tray having at least one side wall and a bottom wall for defining a cavity therein, the at least one side wall having vertical tracking means for defining vertical movement within the tray;

(b) a removable cover for placing over the cavity of the tray comprising:

a centrally transverse opening for permitting dispensing of individual sheets therethrough;

dispensing means for controlling dispensing action comprising:

upward sheet guide means defining transverse edges of said central opening;

downward sheet guide means formed of transverse projections extending downward from said cover to assist movement of sheets through said openings;

sheet dragging means for providing resistance to the dispensing of more than one sheet at a time comprising longitudinal projections extending downward from said cover a distance greater than said downward sheet guides, for contact with a stack; and said upward sheet guide means, downward sheet guide means, and sheet dragging means coacting during the dispensing of a sheet to transversly stress the top sheet so as to enable dispensing of only one sheet per dispensation through said central transverse opening;

(c) cover securing means for releasably securing the cover to the tray comprising:

a snap deflection member disposed on the top of one of said side walls or said removable cover;

a shoulder disposed on the other of said removeable cover or one of said side walls adapted to coact with said deflection member;

tab means extending from said removeable cover on the side opposite the deflection member; and recess means disposed in said side wall adjacent said tab means adapted to coact with said tab means;

(d) a platform of a size suitable for receiving a stack of fanfolded notepaper, having guide means for controlling movement of the platform, said guide means adapted thereon to cooperate mechanically with the vertical tracking means; and (e) biasing means for upwardly urging said platform towards an upper position of the vertical tracking means.

* * * * *